US008434598B2

(12) United States Patent
Simpson

(10) Patent No.: US 8,434,598 B2
(45) Date of Patent: May 7, 2013

(54) CARPET POLE CARRIAGE ASSEMBLY

(75) Inventor: Clark C. Simpson, Nicholasville, KY (US)

(73) Assignee: Clark Material Handling Company, Lexington, KY (US)

( * ) Notice: Subject to any disclaimer, the term of this patent is extended or adjusted under 35 U.S.C. 154(b) by 230 days.

(21) Appl. No.: 12/690,639

(22) Filed: Jan. 20, 2010

(65) Prior Publication Data

US 2010/0181148 A1 Jul. 22, 2010

Related U.S. Application Data

(60) Provisional application No. 61/205,204, filed on Jan. 20, 2009.

(51) Int. Cl.

| | |
|---|---|
| ***B66F 9/18*** | (2006.01) |
| ***B66F 9/08*** | (2006.01) |
| ***B66F 9/12*** | (2006.01) |

(52) U.S. Cl.

USPC ..... 187/237; 414/607; 414/785; 414/911; 187/230

(58) Field of Classification Search ..... 414/607, 414/785, 910, 911; 187/237; 254/7 B, 100, 254/103; *B66F 9/08, 9/18, 9/06, 9/075, 9/12*

See application file for complete search history.

(56) References Cited

U.S. PATENT DOCUMENTS

| | | | | |
|---|---|---|---|---|
| 1,661,386 | A * | 3/1928 | Remde | 414/639 |
| 3,705,658 | A | 12/1972 | Harris | |
| 3,730,368 | A | 5/1973 | Dalglish | |
| 3,734,328 | A | 5/1973 | Dalglish | |
| 4,212,478 | A | 7/1980 | McGrath, Jr. | |
| 4,279,567 | A * | 7/1981 | Thompson | 414/785 |
| 4,593,883 | A * | 6/1986 | Nelson | 254/7 B |
| 5,163,725 | A * | 11/1992 | Leweallyn | 294/219 |
| 5,174,710 | A | 12/1992 | Dragos | |
| 5,320,197 | A | 6/1994 | Connerley et al. | |
| 5,326,217 | A | 7/1994 | Simpson et al. | |
| 5,374,156 | A | 12/1994 | Simpson et al. | |
| 2002/0110446 | A1 | 8/2002 | Smith | |
| 2005/0019144 | A1 | 1/2005 | Neria | |
| 2010/0181147 | A1* | 7/2010 | Simpson | 187/230 |

FOREIGN PATENT DOCUMENTS

| | | | |
|---|---|---|---|
| DE | 3532827 | A1 * | 3/1986 |
| DE | 19515436 | C1 * | 10/1996 |
| EP | 1151959 | A1 * | 11/2001 |
| GB | 2081670 | A * | 2/1982 |
| GB | 2141098 | A * | 12/1984 |
| JP | 52123066 | A * | 10/1977 |
| JP | 02225300 | A * | 9/1990 |
| JP | 09077493 | A * | 3/1997 |

* cited by examiner

*Primary Examiner* — William A Rivera

*Assistant Examiner* — Stefan Kruer

(74) *Attorney, Agent, or Firm* — King & Schickli, PLLC

(57) ABSTRACT

A carpet pole carriage assembly for a lift truck includes a carriage having a front plate and a back plate. The front plate includes a carpet pole receiving opening. A carpet pole retainer is carried on the carriage. A carpet pole retainer includes a first section secured to the front plate about the carpet pole receiving opening and a second section secured to the back plate.

16 Claims, 11 Drawing Sheets

CARPET POLE CARRIAGE ASSEMBLY

This application claims the benefit of U.S. Provisional Patent Application Ser. No. 61/205,204 filed on 20 Jan. 2009, the entire disclosure of which is incorporated herein by reference.

TECHNICAL FIELD AND INDUSTRIAL APPLICABILITY OF THE INVENTION

The present invention relates generally to the lift truck field and, more particularly, to a new an improved carpet pole carriage assembly and upright system for a lift truck as well as a lift truck equipped with said carpet pole carriage assembly and upright system.

BACKGROUND OF THE INVENTION

Lift trucks are often used to lift and carry carpet rolled onto solid paper cores. Such lift trucks include carriage assemblies equipped with a carpet pole that is inserted into the core in order to engage and lift the rolled carpet.

In the past, the carpet pole has been mounted to the carriage assembly is such a way as to cause uneven clamping of the carpet pole, as well as excessive stress and premature failure of the bolting system. Further in many instances, the distal end of the carpet pole becomes jammed in the socket in which it is held and thus very difficult to remove.

In addition, past carriage assemblies have not been designed to accommodate the paper core on which the carpet is rolled. More specifically, the end of the core often projects outwardly beyond the end of the rolled carpet. As the carpet is engaged for lifting, the carriage assembly often engages the projecting end of the core resulting in damage to core.

The present invention addresses and solves these problems.

SUMMARY OF THE INVENTION

In accordance with the purposes of the present invention as described herein, a carpet pole carriage assembly is provided for a lift truck. The carpet pole carriage assembly comprises a carriage including a front plate and a back plate. The front plate includes a carpet pole receiving opening. Further, the assembly includes a carpet pole retainer carried on the carriage. The carpet pole retainer includes a first section secured to the front plate about the carpet pole receiving opening and a second section secured to the back plate.

In accordance with yet another aspect of the present invention a carpet pole carriage assembly is provided for a lift truck. That carpet pole carriage assembly comprises a carriage, a carpet pole retainer carried on the carriage, a carpet pole held in the carpet pole retainer and a core protector carried on the carriage. The core protector includes a carpet core receiving opening extending substantially around the carpet pole. The lift truck is adapted to convey a carpet rolled onto a core where the core has an outer diameter $D_4$ and an inner diameter $D_5$. The carpet pole has an outer diameter $D_1$ which is less than $D_5$ and the carpet pole receiving opening has a diameter $D_2$ which is greater than $D_4$.

In accordance with yet another aspect of the present invention the lift truck is provided with a frame, body work, operator controls, a power and drive system for propelling the truck, operating truck systems including an upright and carriage assembly and steerable end drive wheels for maneuvering the truck over a surface. The lift truck incorporates an improvement comprising an upright assembly including multiple mast sections, a first mast section of said multiple mast sections including opposing siderails and at least two tie bars to secure said siderails together whereby space is defined inside said siderails. The carpet pole carriage assembly is mounted for translational movement with respect to the first mast section. The carriage assembly is carried on the first mast section inside the siderails in the space.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiments of the present invention, examples of which are illustrated in the accompanying drawings.

DETAILED DESCRIPTION OF THE PREFERRED EMBODIMENTS OF THE INVENTION

Figure 1:
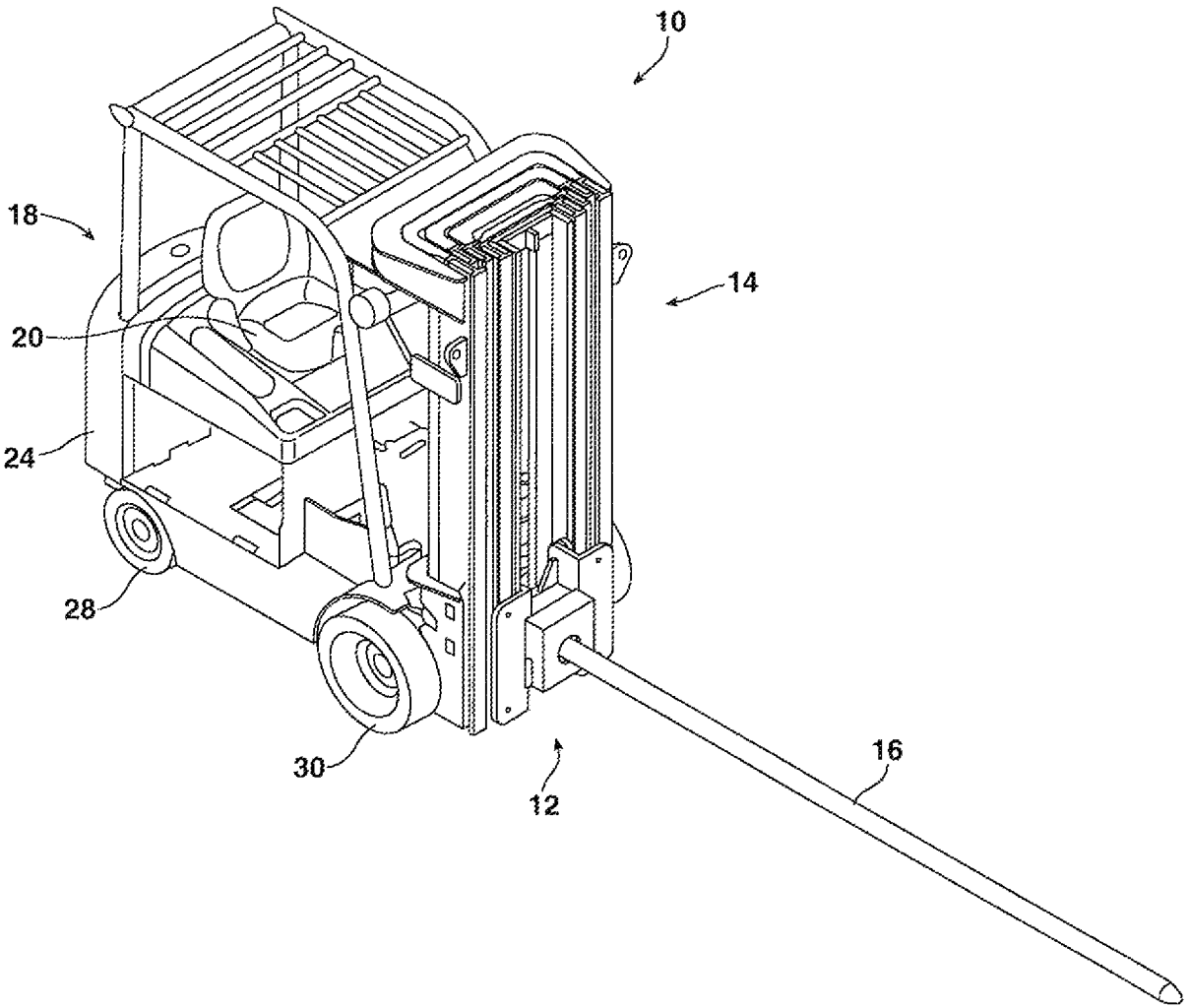
FIG. 1 is a perspective view of a lift truck incorporating the carpet pole carriage assembly of the present invention in the fully lowered position.
Figure 2:
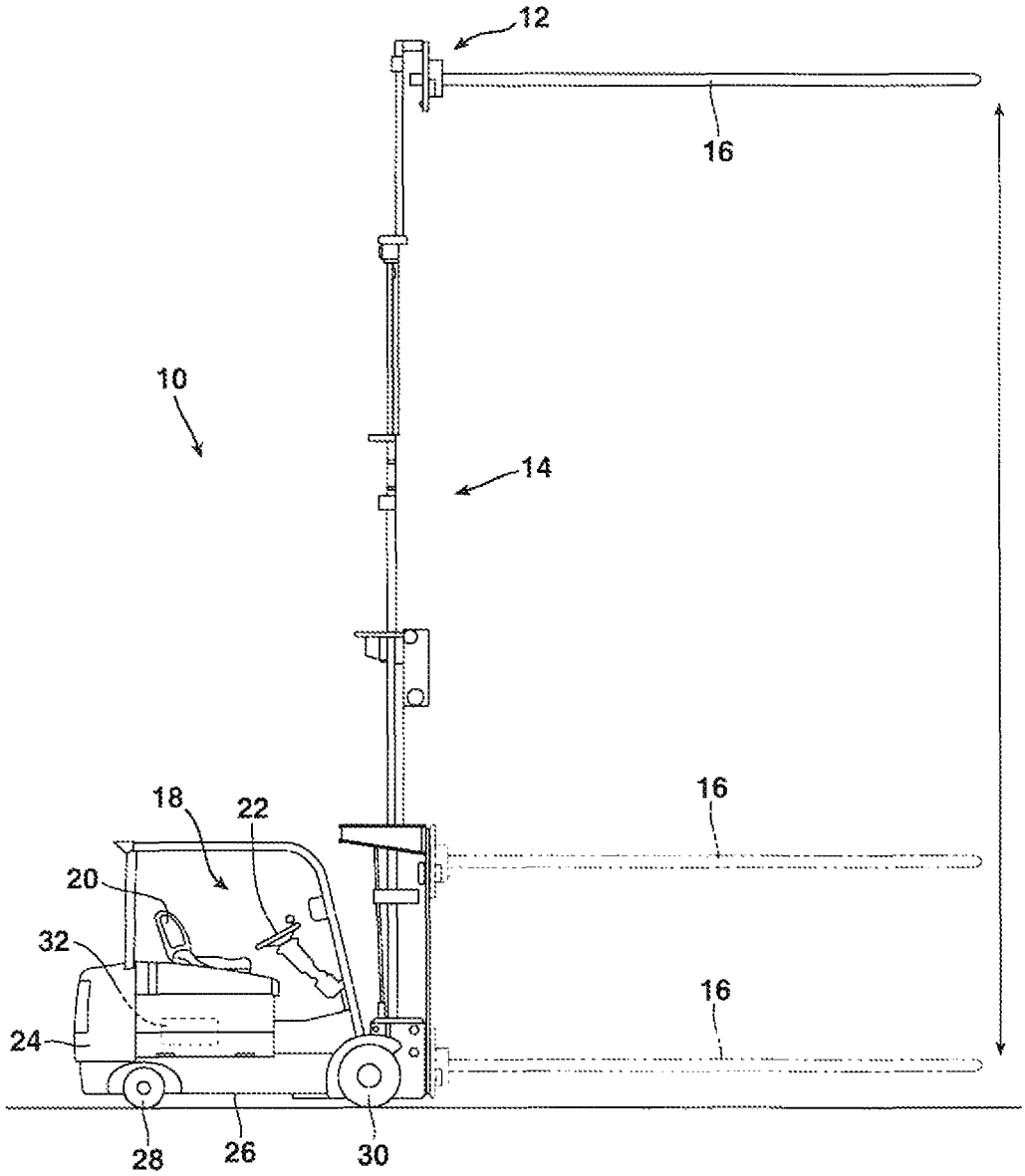
FIG. 2 is a side elevational view illustrating the carpet pole carriage assembly in the fully raised position.

Reference is now made to FIGS. 1 and 2 showing a lift truck 10 equipped with the carpet pole carriage assembly 12 and five stage upright 14 of the present invention. The five stage upright 14 allows the carpet pole carriage assembly 12, including the carpet pole 16, to be moved from a lower most position illustrated in FIG. 1 to a fully extended uppermost position illustrated in FIG. 2. As should be appreciated, the lift truck 10 includes a cab 18 having a seat 20, and operator controls 22. The lift truck 10 also includes body work 24 held on a frame 26 equipped with steerable wheels 28 and drive wheels 30 for maneuvering the lift truck over a surface. A drive system 32 for propelling the lift truck 10 and operating lift truck systems is positioned on the frame 26 under the body work 24.

Figure 3A:
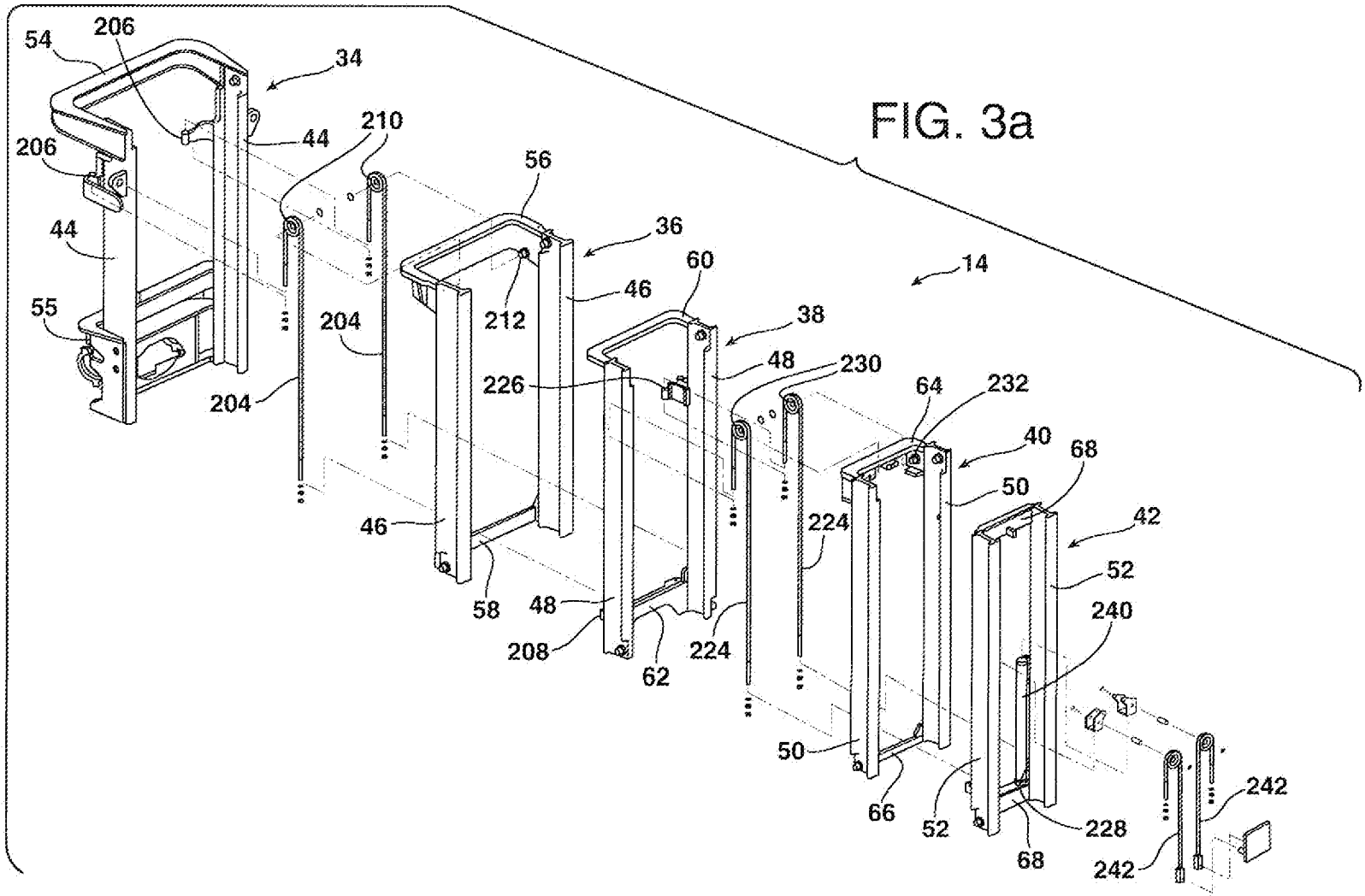
FIG. 3 is a detailed, exploded perspective view illustrating the five stage upright used on the lift truck illustrated in FIGS. 1 and 2.
Figure 3B:
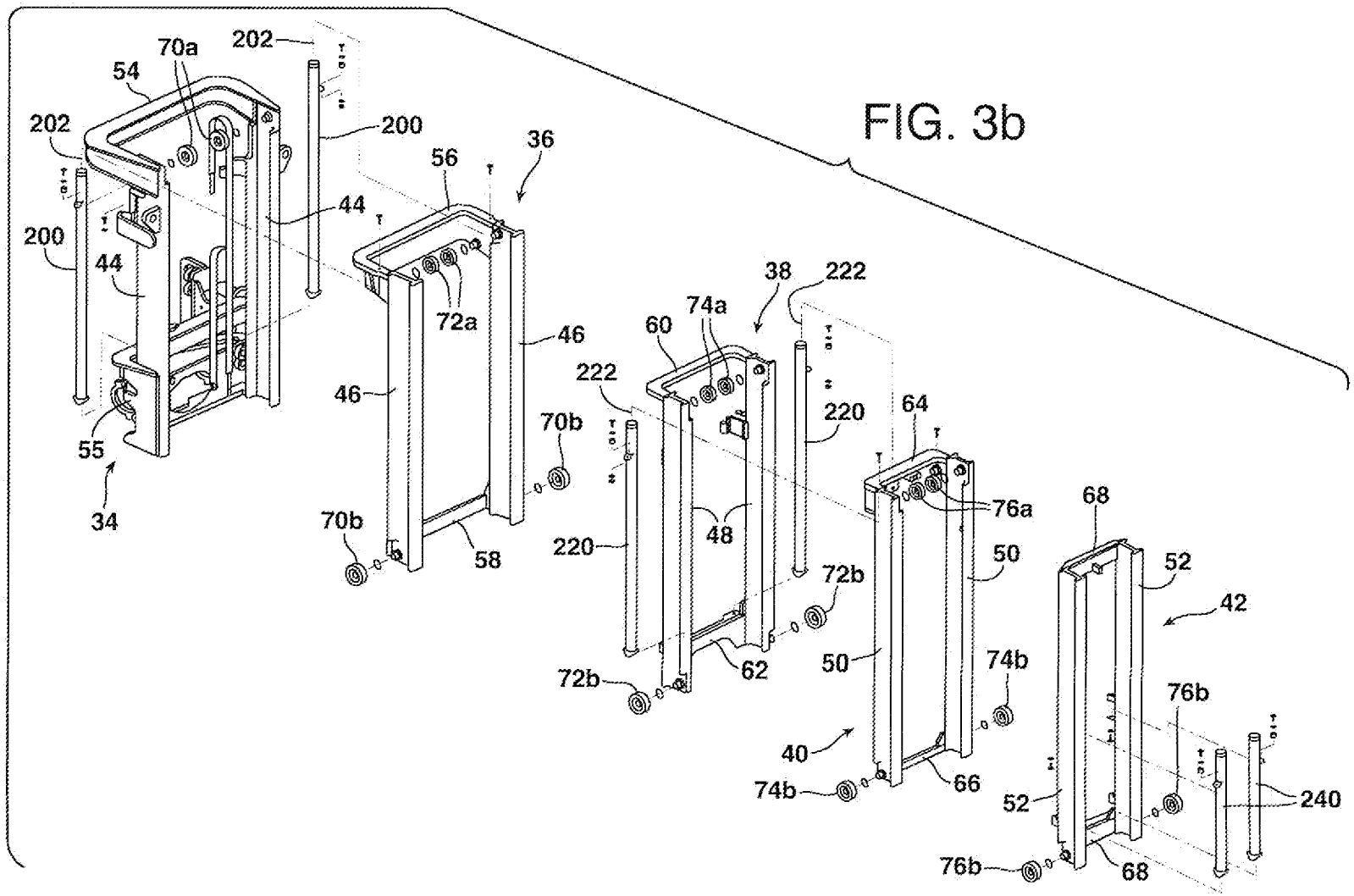
Figure 4A:
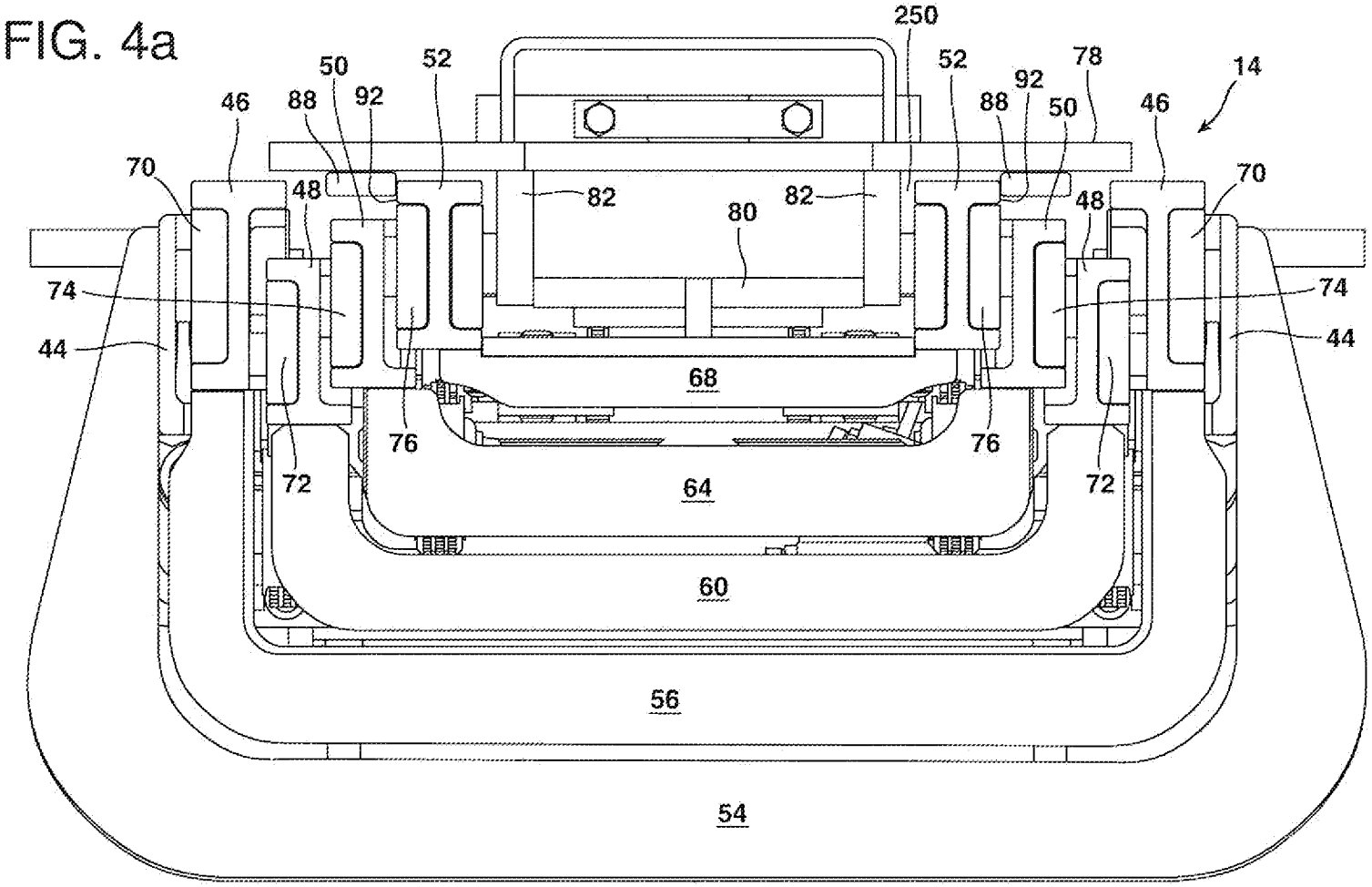
FIG. 4*a* is a detailed, top plan view of that five stage upright in the fully lowered position.
Figure 4B:
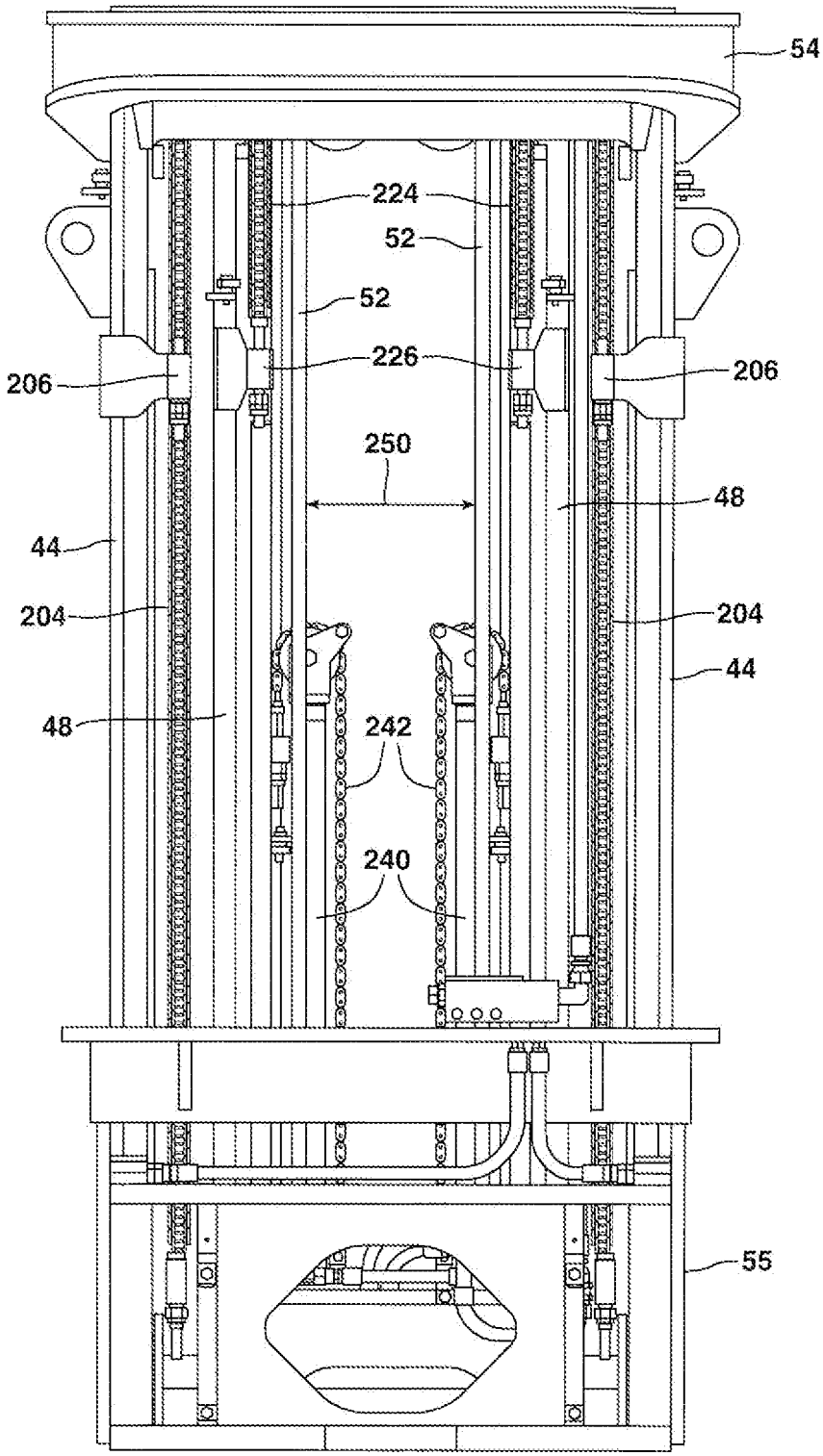
FIG. 4*b* is a detailed rear elevational view of the five stage upright also in the fully lowered position.

Reference is now made to FIGS. 3, 4*a* and 4*b* which illustrate the five stage upright 14 in detail. As illustrated, the five stage upright 14 includes first, second, third, fourth and fifth mast sections 34, 36, 38, 40, 42 in telescoping relation to each other. Each mast section 36, 38, 40, 42 comprises a pair of laterally spaced interconnected telescopic I-beam rails 46, 48, 50, 52 respectively. The first mast section 34 comprises a pair of laterally spaced C-beam rails 44. As best illustrated in FIG. 4*a*, the rails 44, 46, 48, 50 and 52 are mounted and nested in overlapping relation to each other. Accordingly, the first or outer mast section 34 receives the second mast section 36 which receives the third mast section 38 which receives the fourth mast section 40 which receives the fifth mast section 42.

As illustrated, the rails 44 of the first mast section 34 are secured together by upper and lower u-shaped tie bars 54, 55. Lower tie bar 55 is secured to the frame 26 of the lift truck 10 by a series of pins (not shown) in order to mount the five stage upright 14 to the lift truck 10.

The rails 46 of the second mast section 36 are connected together by a tie bar 56 and a cross bar 58. The rails 48 of the third mast section 38 are secured together by the tie bar 60 and cross bar 62. The rails 50 of the fourth mast section 40 are secured together by the tie bar 64 and cross bar 66. The rails 52 of the fifth mast section 42 are secured together by the two cross bars 68. The u-shaped tie bars 54, 55, 56, 60 and 64 and the cross bars 58, 62, 66 and 68 are arranged so that they pass inside of each other as required during movement of the mast sections 34, 36, 38, 40 and 42 relative to each other. Thus, it should be appreciated that there is no interference between the tie bars 54, 55, 56, 60 and 64 and cross bars 58, 62, 66 and 68 of the mast sections 34, 36, 38, 40, 43 during telescopic movement in either direction.

As best illustrated in FIGS. 3*b* and 4*a*, opposing guide rollers 70*a* are secured to the rails 44 of the first mast section 34. These rollers 70*a* are received in the outer channel of the rails 46 of the second mast section 36. Two rollers 70*b* are also provided on the outer channel of the rails 46 of the second mast section 36. Together, the rollers 70*a*, 70*b* support the second mast section for smooth telescoping movement relative to the first mast section 34. Similarly, rollers 72*a* mounted to the inner channel of the rails 46 of the second mast section 36 are received in the outer channel of the rails 48 of the third mast section 38. Two additional rollers 72*b* are provided on the outer channel of the rails 48 of the third mast section 38. Together, the rollers 72*a*, 72*b* support the third mast section 38 for smooth telescoping movement relative to the second mast section 36. Two rollers 74*a* secured to the inner face of the rails 48 of the third mast section 38 are received in the outer channel of the rails 50 of the fourth mast section. Two additional rollers 74*b* are secured on stub shafts to the outer channel of the rails 50 of the fourth mast section 40. Together, the rollers 74*a* and 74*b* support the fourth mast section 40 for smooth telescoping movement relative to the third mast section 38. Two rollers 76*a* secured to the inner face of the rails 50 of the fourth mast section 40 are received in the outer channels of the inner rails 52 of the fifth mast section 42. Two additional rollers 76*b* secured to the inner channel of the rails 52 of the fifth mast section 42 engage the outer channel of the rails 50 of the fourth mast section 40. Together the rollers 76*a*, 76*b* support the fifth mast sections 42 for smooth telescoping movement relative to the fourth mast section 40. As should be appreciated, the forward face of the rails 46 of the second mast section 36 are substantially aligned with the forward face of the rails 52 of the fifth mast section 42. This is accomplished by means of a reverse nesting arrangement. The carpet pole carriage assembly 12 is mounted for translational movement along the rails 52 of the fifth mast section 42.

A first set of lift cylinders 200 is secured to the first mast section 36 (see FIGS. 3*a*, 3*b* and 4*b*). The lift cylinders 200 include pistons 202 having distal ends connected to the tie bar 56 of the second mast section 38. A first set of lift chains 204 have first ends connected by the brackets 206 to the first mast section 36 and second ends connected by brackets 208 to the third mast section 40. The lift chains 204 also engages sheaves 210 held on stub shafts 212 carried on the tie bar 56 of the second mast section 38.

A second set of lift cylinders 220 are secured to the third mast section 40. The lift cylinders 220 include pistons 222 having distal ends connected to the tie bar 64 of the fourth mast section 42. A second set of lift chains 224 have first ends connected by the brackets 226 to the third mast section 40 and second ends connected by brackets 228 to the fifth mast section 44. The lift chains 224 also engage sheaves 230 held on stub shafts 232 carried on the tie bar 64 of the fourth mast section 42.

The lift cylinders 200, 220 and first and second sets of lift chains 204, 224 allow the operator to fully raise and lower the upright 14 between the fully lowered and raised positions illustrated in FIGS. 1 and 3 in a manner known in the art.

Figure 5:
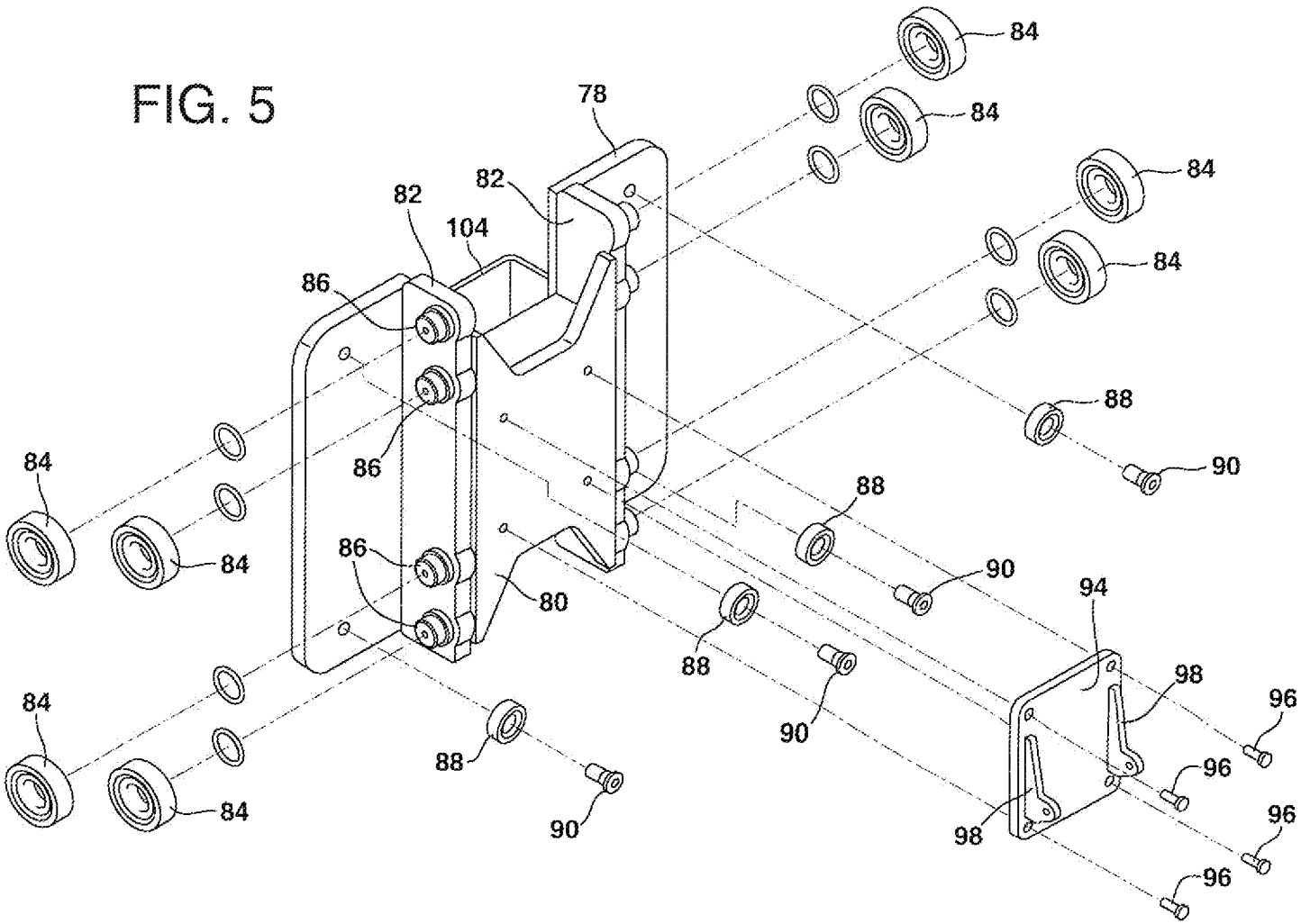
FIG. 5 is an exploded perspective view of the rear of the carpet pole carriage assembly.

As best illustrated in FIGS. 3*a*, 3*b* and 5, the carpet pole carriage assembly 12 includes a front plate 78, a back plate 80 and two opposing sidewalls 82. Four rollers 84 are mounted on spaced stub-shafts 86 along each side wall. These rollers 84 are received in the inwardly facing channels of the rails 52 of the fifth mast section 42 so as to provide smooth movement of the carpet pole carriage assembly 12 along the fifth mast section. The increased roller spread and the large number of rollers 84 spread the load evenly and increase bearing life. Four side thrust rollers 88 are secured by pins 90 to the rear of the front plate 78. These side thrust rollers 88 engage along the outer edge 92 of the rails 52 to resist shifting of the carpet pole carriage assembly 12 from side-to-side along the five state upright 14 thereby reducing deflection wear of the main carriage rollers 84. As should be appreciated, space for the rollers 88 exist between the rails 46 and rails 52 thanks to the reverse nest arrangement of the mast sections 34, 36, 38, 40 and 42. A carriage lift bracket 94 is secured to the back plate 80 by cap screws 96. The carriage lift bracket 94 includes two opposing clevices 98 that allow connection to the lift cylinders 240 and cooperating chain system 242 that lifts and lowers the carpet pole carriage assembly 12 on the fifth mast section 42.

Figure 6:
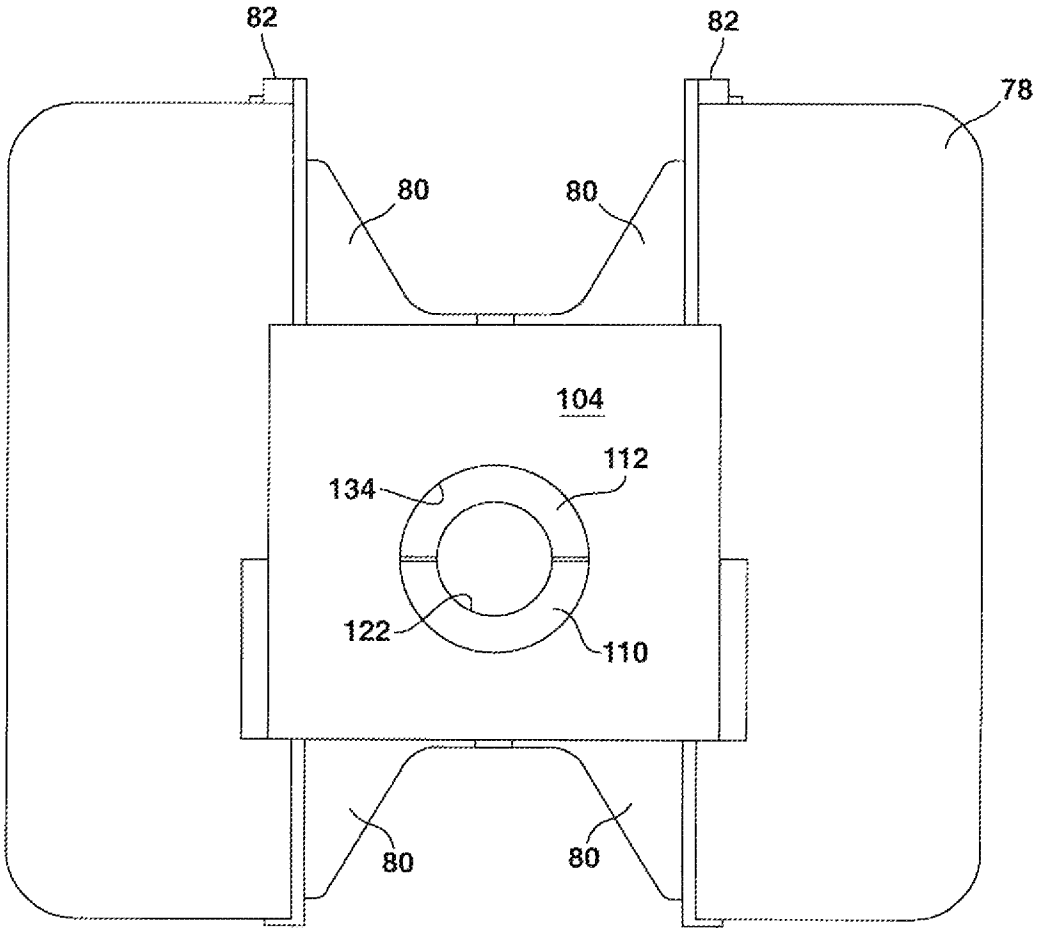
FIG. 6 is a front elevational view of the carpet pole carriage assembly.
Figure 7:
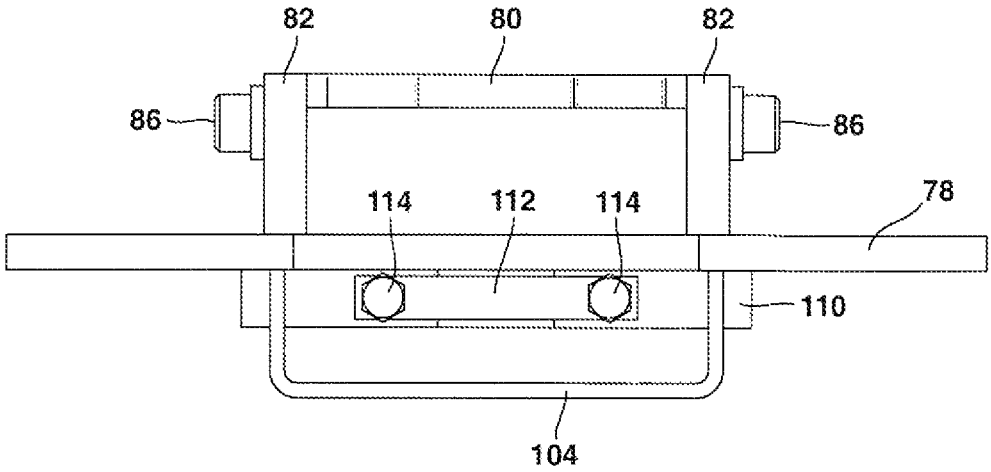
FIG. 7 is a detailed, top plan view of the carpet pole carriage assembly.
Figure 8:
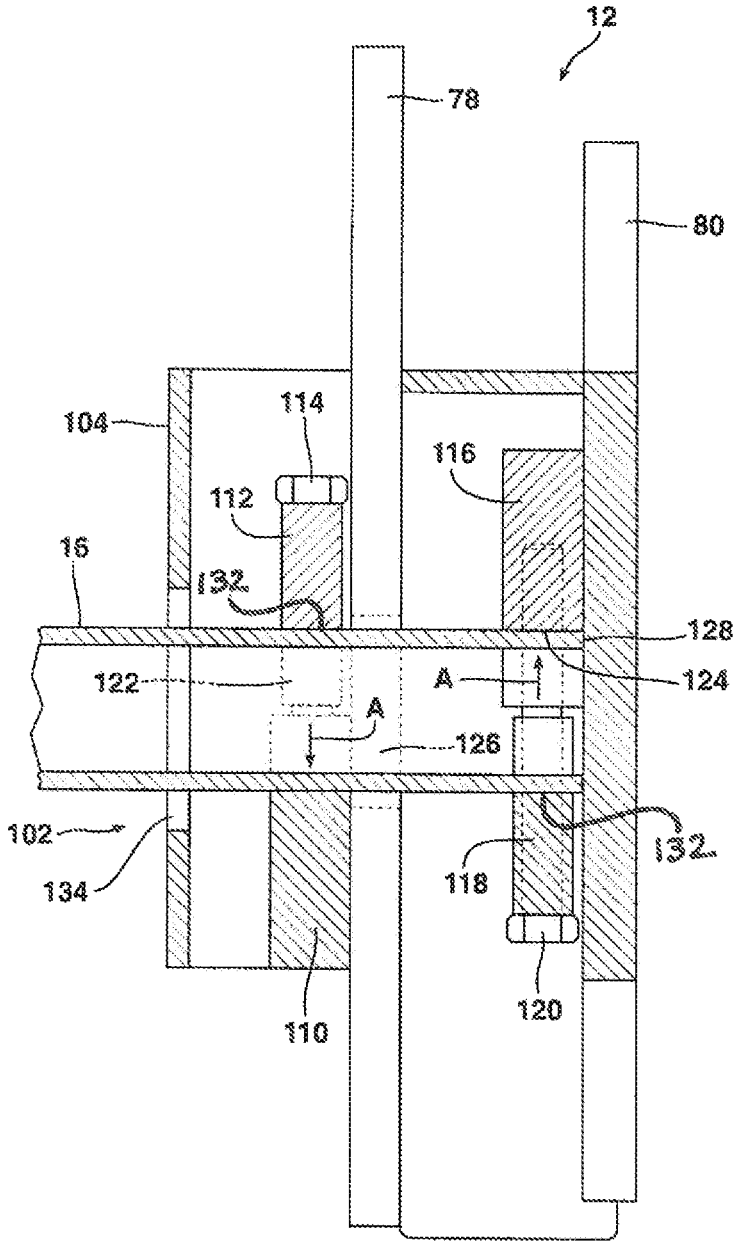
FIG. 8 is a detailed, cross sectional view of the carpet pole carriage assembly.

Reference is now made to FIGS. 6-8 illustrating the carpet pole retainer 102 and core protector 104 on the carpet pole carriage assembly 12. As illustrated, the carpet pole retainer 102 includes a first section 106 secured to the front plate 78 and a second section 108 secured to the back plate 80. The first section 106 of the carpet pole retainer 102 includes a first mounting block 110 secured to the front plate 78 by welding or other appropriate means and a first retainer cap 112 secured to the first mounting block 110 by a first adjustable fastener 114. Similarly, the second section 108 includes a second mounting block 116 secured by welding or other means to the back plate 80 and a second retainer cap 118 secured to the second mounting block by a second adjustable fastener 120. In the illustrated embodiment, the first adjustable fastener 114 and the second adjustable fastener 120 both take the form of two threaded bolts.

As should be appreciated the first mounting block 110 and first retainer cap 112 form a first mounting aperture 122 while the second mounting block 116 and second retainer cap 118 form a second mounting aperture 124. As should be appreciated the first and second mounting apertures 122, 124 are aligned with a carpet pole receiving opening 126 in the front plate 78.

Figure 9:
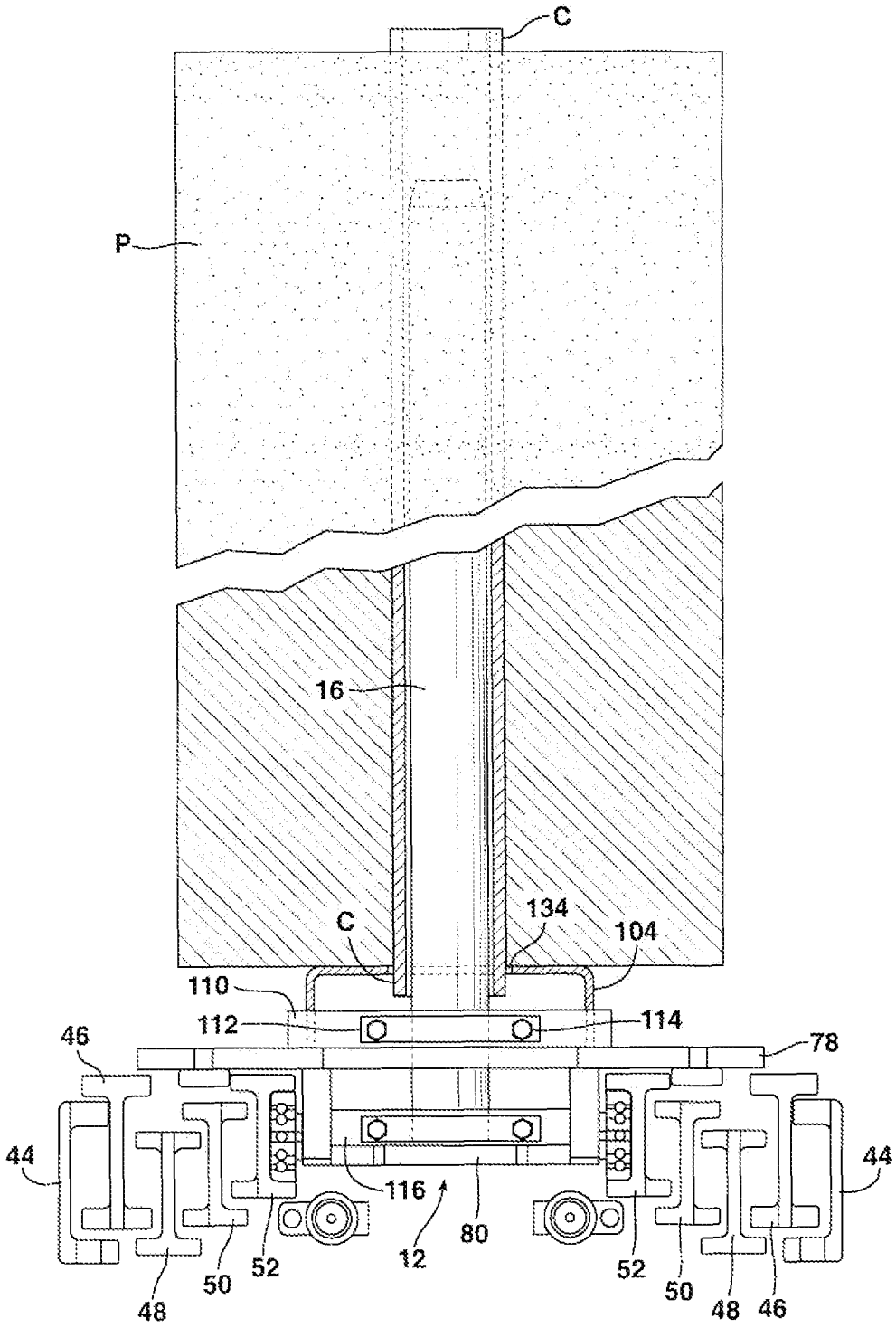
FIG. 9 is a schematical top plan view illustrating how the carpet pole assembly is utilized to engage and lift a carpet rolled into a paper core.

A carpet pole 16 is secured in the carpet pole retainer 102 by inserting the proximal end of the pole through the first mounting aperture 122, the carpet pole receiving opening 126 and the second mounting aperture 124 (see FIGS. 8 and 9). The retaining caps 112 and 118 are then tightened down by the adjustable fasteners 114, 120 to secure the carpet pole in position in the retainer 102. As should be appreciated, the first and second mounting blocks 110, 116 which are fixed to the respective plates 78, 80 engage the loaded sides 120 (note action arrows A) of the carpet pole 16 while the first and second retainer caps 112, 118 and the fasteners 114 engage unloaded sides 132 of the carpet pole. This results in reduced stress on the carpet pole 16 as well as on the carpet pole retainer 102. The system also allows easy removal of the pole 16 by simply loosening the retainer caps 112, 118.

The core protector 104 comprises a substantially u-shaped plate that may be welded or otherwise connected to the front plate 78. The core protector 104 includes a carpet core receiving opening 134 that is aligned with the carpet pole receiver opening 126 in the front plate 78 as well as the first and second mounting apertures 122, 124 of the carpet pole retainer 102. The core C upon which the carpet P is wrapped has an outer diameter $D_4$ and an inner diameter $D_5$. The carpet core receiving opening 134 of the core protector 104 has an outer diameter $D_1$ which is less than $D_5$ and the carpet pole receiving opening 126 has a diameter $D_2$ which is greater than $D_4$. Thus, it should be appreciated that the carpet pole 16 will easily slip inside the core C upon which the carpet P is wound. Typically the core C is longer in length than the rolled carpet P and contact between the carriage assembly and the core has caused damage to the core in the past. The carpet core protector 104 addresses this problem. More specifically, as the carpet pole 16 is inserted into the core, the end of the core passes through the carpet core receiving opening 134 and the core protector 104 until the face of the core protector engages the carpet P wound on the core C. The clearance provided by the core protector 104 protects the core C from engagement with the carriage assembly 12 and potential damage to the core that might otherwise be caused by such engagement during handling.

As perhaps best illustrated in FIGS. 4*a* and 4*b*, an open space 250 exists in the center of the five stage upright 14, and more specifically the fifth mast section 42, between the rails 52. The side walls 82, back plate 80 and second section 108 of the carpet pole retainer 102 are all recessed in the opening 200 between the rails 52. Thus, the mounting of the proximal end 128 of the carpet pole 16 is also recessed into this space 250. This recessing functions to reduce the load center thereby increasing the load carrying capacity of the lift truck T. Significantly, the open space 250 also allows the operator a better field of vision. Thus, the operator can clearly view the carpet pole 16 and guide it into the core C upon which a carpet P is rolled. A more detailed discussion of these benefits may be found in copending U.S. patent application Ser. No. 12/690,639, entitled "Upright for a Lift Truck" and filed concurrently herewith.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A carpet pole carriage assembly for a lift truck adapted to convey carpet rolled on a core wherein said core has a diameter $D_4$, said assembly comprising:

a carriage including a transverse front plate and a transverse back plate, said front plate including a carpet pole receiving opening formed in said front plate; and a carpet pole retainer carried on said carriage, said carpet pole retainer including a first section secured to said front plate about said carpet pole receiving opening and a second section secured to said back plate;

said carpet pole retainer including a first mounting block secured to said front plate and a first retainer cap secured to said first mounting block by a first adjustable fastener and said second section of said carpet pole retainer including a second mounting block secured to said back plate and a second retainer cap secured to said second mounting block by a second adjustable fastener;

said first mounting block and first retainer cap forming a first mounting aperture and said second mounting block and second retainer cap forming a second mounting aperture, said first and second mounting apertures being aligned with said carpet pole receiving opening in said front plate;

a core protector carried on said front plate, said core protector including a carpet core receiving opening aligned with said first and second mounting apertures and said carpet pole receiving opening;

a carpet pole wherein said carpet pole, said first mounting aperture and said second mounting aperture all have a diameter $D_1$, said carpet pole receiving opening has a diameter $D_2$ where $D_2>D_1$ so as to provide clearance for said carpet pole and said carpet core receiving opening has a diameter $D_3$ where $D_3>D_4>D_2$ whereby sufficient clearance is provided to allow an end of said carpet core to pass through said carpet core receiving opening.

2. The carriage assembly of claim 1, wherein a proximal end of said carpet pole is received and held in said second section of said carpet pole retainer.

3. The carriage assembly of claim 2, wherein said carpet pole includes a circular surface in cross section, said first and second mounting blocks engage said carpet pole along a first, loaded semi-circular section of said circular surface while said first and second retainer caps engage unloaded semi-circular sections of said circular surface.

4. The carriage assembly of claim 3, further including a carriage lift bracket secured to said back plate.

5. A lift truck including the carpet pole carriage assembly of claim 1.

6. A carpet pole carriage assembly for a lift truck adapted to convey carpet rolled on a core where said core has an outer diameter $D_4$ and an inner diameter $D_5$, said assembly comprising:

a carriage;

a carpet pole retainer carried on said carriage;

a carpet pole held in said carpet pole retainer; and a core protector carried on said carriage, said core protector including a carpet core receiving opening extending concentrically around said carpet pole, said carpet pole having an outer diameter $D_1$ which is less than the inner diameter $D_5$ and said carpet pole receiving opening having a diameter $D_2$ which is greater than the outer diameter $D_4$ whereby an end of the core enters and is received in said carpet core receiving opening when the carpet is engaged by said core protector.

7. A lift truck including the carpet pole carriage assembly of claim 6.

8. In a lift truck having a frame, body work, operator controls, a power and drive system for propelling the truck and operating truck systems including an upright and carriage assembly and steerable and drive wheels for maneuvering the truck over a surface, an improvement comprising:

an upright assembly including multiple mast sections, a first mast section of said multiple mast sections including opposing side rails and at least two tie bars to secure said side rails together, whereby a space is defined inside said side rails;

a carpet pole carriage assembly mounted for translational movement with respect to said first mast section, said carriage assembly being carried on said first mast section inside of said side rails in said space;

a core protector carried on said carpet pole carriage assembly, said core protector including a carpet core receiving opening; and a carpet pole carried on said carpet pole carriage assembly, said carpet pole projecting through said carpet core receiving opening and said carpet core receiving opening providing a gap between said core protector and said carpet pole whereby, when said carpet pole is received in a carpet core to lift a carpet rolled on said carpet core, an end of said carpet core enters and is received in said gap.

9. In the lift truck according to claim 8, the improvement further comprising:

said carpet pole carriage assembly having a carriage including a front plate, a back plate and two side plates, said front plate including a carpet pole receiving opening; and a carpet pole retainer carried on said carriage, said carpet pole retainer including a first section secured to said front plate about said carpet pole receiving opening and a second section secured to said back plate.

10. In the lift truck according to claim 9, the improvement further comprising, said first section of said carpet pole retainer including a first mounting block secured to said front plate and a first retainer cap secured to said first mounting block by a first adjustable fastener and said second section of said carpet pole retainer including a second mounting block secured to said back plate and a second retainer cap secured to said second mounting block by a second adjustable fastener.

11. In the lift truck according to claim 10, the improvement further comprising, said first mounting block and first retainer cap forming a first mounting aperture and said second mounting block and second retainer cap forming a second mounting aperture, said first and second mounting apertures being aligned with said carpet pole receiving opening in said front plate.

12. In the lift truck according to claim 11, wherein said carpet pole extends through said second mounting aperture, said carpet pole receiving opening and said first mounting aperture.

13. In the lift truck according to claim 12, the improvement further comprising, a proximal end of said carpet pole received and held in said second section of said carpet pole retainer.

14. In the lift truck according to claim 13, the improvement further comprising, said carpet pole including a circular surface in cross section said first and second mounting blocks engaging said carpet pole along a first, loaded semi-circular section of said circular surface while said first and second retainer caps engage said carpet pole along a second unloaded semi-circular section of said circular surface.

15. In the lift truck according to claim 11, wherein said carpet core receiving opening is aligned with said first and second mounting apertures and said carpet pole receiving opening.

16. In the lift truck according to claim 15, wherein said carpet pole, said first mounting aperture and said second mounting aperture all having a diameter $D_1$, said carpet pole receiving opening having a diameter $D_2$ where $D_2>D_1$ so as to provide clearance for said carpet pole, and said carpet core receiving opening having a diameter $D_3$ and said carpet core having an outer diameter $D_4$ where $D_3>D_4>D_2$ whereby sufficient clearance is provided to allow an end of said carpet core to pass through said carpet core receiving opening.

* * * * *